United States Patent [19]

Schuessler et al.

[11] 4,048,601

[45] Sept. 13, 1977

[54] SWITCH MOUNTING ASSEMBLY FOR AN ELECTROMAGNETIC RELAY

[75] Inventors: John C. Schuessler, West Covina; David J. Tapp, Manhattan Beach, both of Calif.

[73] Assignee: Leach Corporation, Los Angeles, Calif.

[21] Appl. No.: 691,003

[22] Filed: May 28, 1976

[51] Int. Cl.[2] ..... H01H 50/30

[52] U.S. Cl. ..... 335/193; 335/200; 335/277

[58] Field of Search ..... 200/288; 335/128, 133, 335/193, 194, 200, 269, 271, 274, 277

[56] References Cited

U.S. PATENT DOCUMENTS

| | | | |
|---|---|---|---|
| 2,619,569 | 11/1952 | Savage | 335/200 X |
| 3,484,729 | 12/1969 | Adams et al. | 335/200 |
| 3,880,476 | 4/1975 | Belart et al. | 335/274 X |
| 3,898,596 | 8/1975 | Richards et al. | 335/193 X |

*Primary Examiner*—A. D. Pellinen

*Attorney, Agent, or Firm*—Christie, Parker & Hale

[57] ABSTRACT

In an electrical relay in which the moving contacts of a switch are actuated by the pivoting movement of an armature, the moving contacts are carried by a blade which is supported on the armature by a contact carrier in the form of an insulating block. The carrier is anchored to the armature by a pair of clamping members having cantilevered spring fingers that engage recesses in the margins of the carrier to clamp the carrier against the armature and secure the carrier against lateral movement.

10 Claims, 7 Drawing Figures

Fig. 3
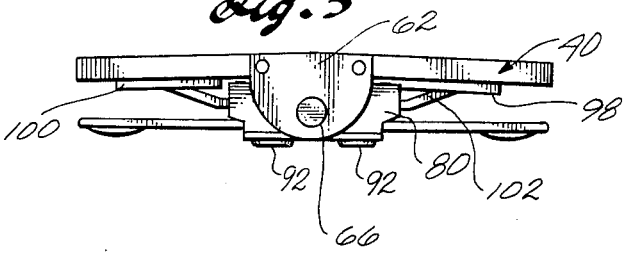
Fig. 4
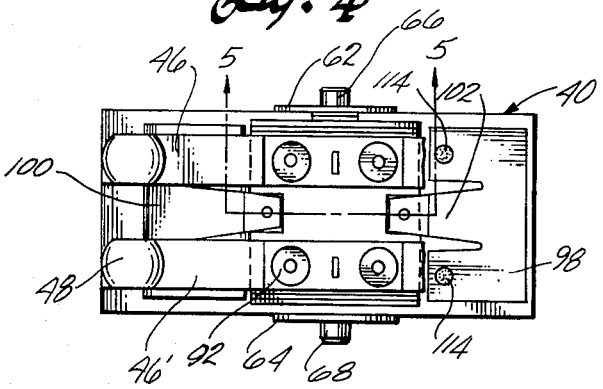
Fig. 5
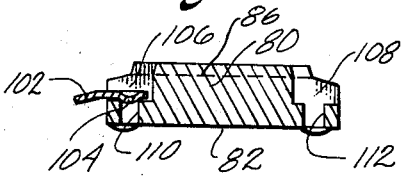
Fig. 6
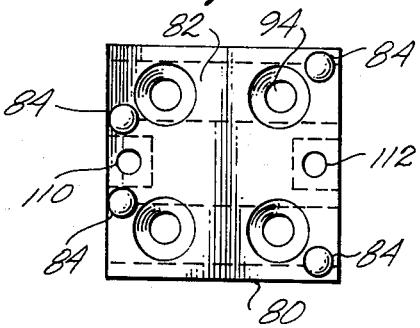
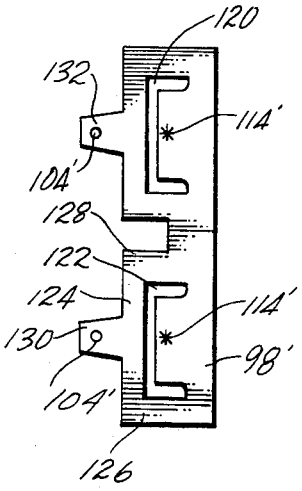
Fig. 7

SWITCH MOUNTING ASSEMBLY FOR AN ELECTROMAGNETIC RELAY

FIELD OF THE INVENTION

This invention relates to electromagnetic relays, and more particularly, is concerned with a moving contact assembly for an electric relay.

BACKGROUND OF THE INVENTION

High performance relays are utilized in great numbers in the aircraft, aerospace, and electronics industries in which a premium is placed on minimum weight and physical size for operation under extreme environmental conditions and with high electrical capacities. Relays capable of switching current of 10 amperes or more at switching times of less than a millisecond and occupying total volume of less than seven cubic centimeters make the design and manufacture of the relay parts extremely critical and expensive. In attempting to scale down the size of component parts to reduce the weight and size of the relay, careful attention must be given to strengths of materials in order to withstand shocks of up to 200 g's, vibrations of up to 50 g's, and at the same time the relay must provide minimum contact resistance, as well as sufficient insulation and spacing to prevent voltage breakdown and arcing.

One area of design which has presented problems in achieving a satisfactory relay design is in the mounting of the moving contacts on the armature which is actuated by the electromagnet of the relay. The moving contacts must be firmly supported to maintain high contact pressure with minimum chatter or bounce. The contacts must be insulated from the actuating armature in a manner to withstand breakdown under voltage gradients of 1500 volts or more. At the same time, the mounting arrangement must occupy a minimum of space and yet be rugged, foolproof, easy to assemble.

In the past, movable contacts have been mounted on the armature by various means such as rivets or other fastening devices. These tend to loosen or fail in use and present design and assembly problems. A mounting arrangement is shown in U.S. Pat. No. 3,484,729, assigned to the same assignee as the present invention in which an insulating contact carrier is clamped to the armature by the pivot shaft. The arrangement permits assembly without the use of rivets or the like. However, such an arrangement has been found unsuitable for extremely small relays with reduced electrical clearances between parts.

SUMMARY OF THE INVENTION

The present invention is directed to an improved arrangement for mounting the moving electrical switch contacts of a relay on the armature of the electromagnetic relay motor. The present invention provides an extremely compact mounting arrangement without sacrifice in strength and electrical isolation between the contacts and the armature. This is accomplished, in brief, by providing a contact blade assembly for a relay in which an insulating contact carrier in the form of a thin block of insulating material to which one or more contact blades are attached. It is clamped to the armature of the relay by clamping members having cantilevered fingers welded to the armature and projecting toward each other. The inner ends of the fingers engage recesses in the margin of the insulating contact carrier for holding the carrier securely against the armature.

The fingers and recesses are formed with interlocking projections and openings receiving the projections to secure the carrier against lateral movement relative to the armature and fingers.

DESCRIPTION OF THE DRAWINGS

For a more complete understanding of the invention reference should be made to the accompanying drawings, wherein:

FIG. 3 is a side elevational detail of an armature assembly;

FIG. 4 is a bottom view of the armature assembly;

FIG. 5 is a sectional detail view taken substantially on the line 5—5 of FIG. 4;

FIG. 6 is a bottom view of the contact carrier; and

FIG. 7 is a plan view of an alternate embodiment.

DETAILED DESCRIPTION

Figure 1:
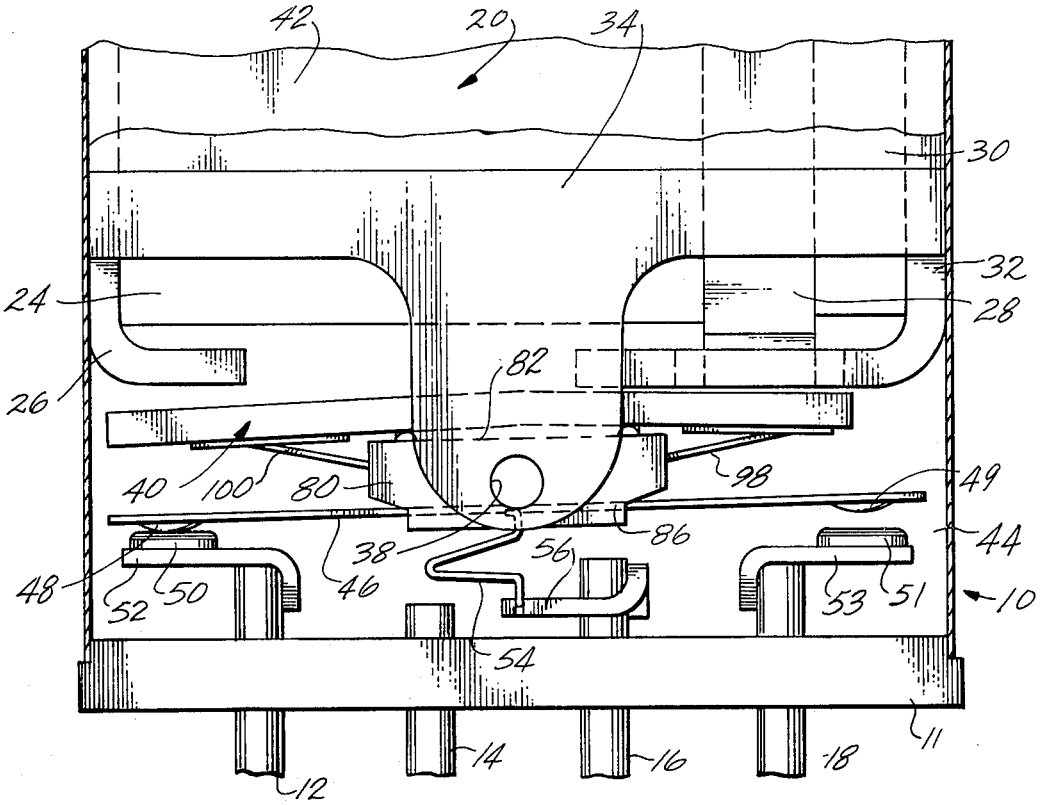
FIG. 1 is a side elevational view partly in section of a relay according to the present invention.

Referring to the drawings in detail, the numeral 10 indicates generally a relay of the type described in more detail in copending application Ser. No. 669,217, filed Mar. 22, 1976, entitled "Improved Electromagnetic Actuator for a Relay", and assigned to the same assignee as the present invention. The relay includes a header 11 providing a hermetically sealed support for a plurality of pairs of contact pins 12, 14, 16 and 18. The header 11 is rigidly attached to an electromagnetic motor assembly by a pair of side plates 42 and 44 which are secured to the motor assembly and the header by spot welding, or the like.

The electromagnetic motor assembly 20 includes an electromagnetic coil 24 extending between a pair of pole pieces 26 and 28. A permanent magnet 30 is positioned between the pole member 28 and an additional pole piece 32. The motor assembly 20 further includes a pair of armature support plates 34 and 36 which are welded or otherwise attached to the pole pieces 26, 28, and 32. The armature support plates include holes 38 by which an armature assembly, indicated generally at 40, is pivotally supported. The pivoted armature assembly 40 of the motor assembly 20 includes one or more contact blades 46. Opposite ends of the blades are provided with electrical moving contacts 48 and 49 which are rotated in and out of contact with fixed contacts 50 and 51. The fixed contact 50 is supported from the contact pin 12 by a contact bracket 52 welded to the pin. Similarly the fixed contact 51 is supported from the contact pin 18 by a support bracket 53. The contact pin 16 is connected to an intermediate point on the moving contact blade 46 by a contact plate 96 and a U-shaped spring connector 54 and contact bracket 56 welded to the pin 16.

The armature assembly 40 includes an armature member 60 of ferro-magnetic material in the form of an elongated rectangular flat bar which is bent slightly at the center. A pair of armature support brackets 62 and 64 are welded to the edges of the armature 60. The armature support brackets 62 and 64, respectively, have secured thereto a pair of axially aligned stub shafts 66 and 68 which are journaled in the holes 38 of the armature support members 34 and 36. Telfon spacers 70 and 72 center the armature assembly 40 between the armature support member 34 and 36. Energizing and de-energizing of the coil 24 causes armature 60 to rotate about the axis of the stub shafts 66 and 68 between two positions. As shown in FIG. 1, the armature is in the de-energized position in which it is held against the pole pieces 28 and 32 by the permanent magnet 30. When the coil 24 is electrically energized, the armature rotates from the position shown in FIG. 1 in a clockwise direction so as to come into contact with the pole piece 26.

Figure 2:
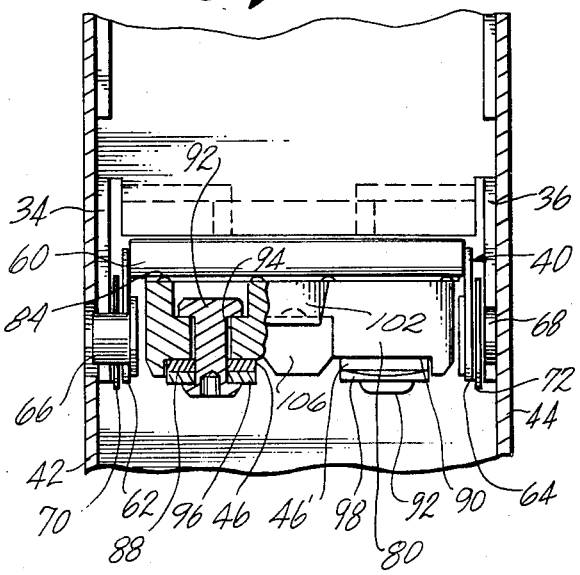
FIG. 2 is a fragmentary end view partly in section of the relay of FIG. 1.

The present invention is specifically directed to the arrangement by which the contact blades 46 are mounted on the armature 60 so as to provide a double pole switching action with the fixed contacts 50 and 51, respectively. The relay of FIGS. 1 and 2 provides a double pole switch with a pair of contact blades 46 and 46' extending parallel to each other. The contact blades are mounted on a contact carrier 80 molded or otherwise formed from an insulating material such as plastic or ceramic. The contact carrier is a substantially square block with a flat surface 82 on one side having a plurality of projecting spherically shaped bosses or protrusions 84 on which the contact carrier is supported against the surface of the armature 60. Two of the protrusions are at the outer corners on one edge of the surface 82 and two of the protrusions are closely spaced near the center of the opposite edge of the surface 82, providing in effect a three-legged support for the carrier on the armature. The opposite surface 86 of the contact carrier 80 is formed with a pair of parallel channels 88 and 90 in which the contact blades 46 and 46' are seated. The contact blades are held in place by rivets 92 which extend through countersunk holes 94 in the contact carrier. Overlying clamping plates 96 are engaged by the rivets 92 to clamp the contact blades against the contact carrier.

The armature assembly 40 is completed by positioning the contact carrier with the attached contact blades in position against the surface of the armature 60 between the armature brackets 62 and 64. The contact carrier 80 is locked in place by a pair of clamping members 98 and 100. As shown in FIG. 4, the clamping members are substantially E-shaped and are formed from a flat spring stock. The E-shape provides a center leg 102 which is longer than the two outer legs of the clamping member. The outer end of the center leg 102 is bent slightly out of the plane of the flat stock and dimpled to form a spherically-shaped projection 104. The contact carrier is formed with a pair of recesses 106 and 108 lying between the blade supporting channels 88 and 90. The recesses provide a clamping surface which is substantially parallel to the flat surface 82. Holes 110 and 112 extend between the flat clamping surfaces of the recesses 106 and 108, respectively, and the surface 82. When assembled, the center leg 102 of each of the clamping members 98 and 100 has the outer end thereof positioned in an associated one of the recesses 106 and 108 with the dimple 104 engaging the associated one of the openings 110 and 112, as shown in detail in FIG. 5.

After the contact carrier is placed in position against the armature with the clamping members 98 and 100 in position, the outer legs of the clamping members are spot-welded to the armature 60, as indicated at 114. This causes the center legs 102 to be deflected out of the plane of the clamping members. Thus the center leg 102 acts as a cantilever spring, which, due to the deflection, produces a restoring force that acts to clamp the contact carrier securely against the armature 60. Engagement of the dimples 104 with the holes 110 and 112, respectively, in the contact carrier acts to securely position the contact carrier against lateral movement in any direction.

An alternate clamping member design is shown in FIG. 7. The design is suitable for a four-pole relay having two carriers side-by-side on the armature, each carrier supporting a pair of contact blades. The clamping member 98' has two generally rectagular portions each with a U-shaped slot indicated at 120 and 122, forming a center section 124 and two outer legs 126 and 128. The spring is welded to the armature 60 at the center section formed by each slot, the weld points being indicated at 114'. The spring is formed with two outer spring legs 130 and 132 having a dimple 104' for engaging respective carriers in the manner described above. This arrangement has the advantage that the weld 114' is done between the two contact blades 46 and 46' of each carrier of the four-pole relay. Access to the spring clamping members by the spot-welding electrodes is easier since the welding is done between the contact blades.

What is claimed is:

1. A contact blade assembly for a relay or the like comprising a magnetic armature, a contact blade, an insulating contact carrier positioned between the armature and the contact blade, means securing the contact blade to the carrier, the carrier having a pair of recesses formed along opposite margins, and clamping means secured to the armature having cantilevered spring fingers projecting toward each other, the inner end of the fingers engaging said recesses in the carrier for holding the carrier against the armature.

2. The apparatus of claim 1 wherein said fingers and recesses are formed with interlocking projections and openings receiving the projections to secure the carrier against lateral movement relative to the armature and fingers.

3. The apparatus of claim 2 wherein the carrier has a plurality of bosses projecting from one surface, two of the bosses being positioned adjacent the corners of the carrier along one margin, and two bosses being positioned adjacent the center along the opposite margin, the bosses engaging the surface of the armature.

4. Apparatus of claim 2 wherein the projections are spherically-shaped dimples adjacent the inner ends of the spring fingers.

5. Apparatus of claim 1 wherein the clamping means includes a pair of E-shaped flat springs, the center leg being longer than the outer legs, the outer legs being secured to the armature with the center legs forming the spring fingers.

6. The apparatus of claim 5 wherein said fingers and recesses are formed with interlocking projections and openings receiving the projections to secure the carrier against lateral movement relative to the armature and fingers.

7. Apparatus of claim 6 wherein the projections are spherically-shaped dimples adjacent the inner ends of the spring fingers.

8. Apparatus of claim 1 wherein the clamping means includes a pair of flat springs, each spring including a substantially rectangular portion with a U-shaped slot and a projecting finger portion, the portion within the U-shaped slot being secured to the armature and the portion outside the slot forming a pair of supporting flexible springs for the finger.

9. The apparatus of claim 8 wherein said fingers and recesses are formed with interlocking projections and openings receiving the projections to secure the carrier against lateral movement relative to the armature and fingers.

10. Apparatus of claim 9 wherein the projections are spherically-shaped dimples adjacent the inner ends of the spring fingers.

* * * * *